United States Patent [19]

Milford et al.

[11] Patent Number: 4,741,375

[45] Date of Patent: May 3, 1988

[54] ADJUSTABLE SOLARIUM SHADE

[76] Inventors: Patricia Milford; Laurence Milford, both of 7600 Trail Blvd. N., Naples, Fla. 33940

[21] Appl. No.: 487,176

[22] Filed: Apr. 21, 1983

[51] Int. Cl.[4] ..... A47H 5/00

[52] U.S. Cl. ..... 160/84.1

[58] Field of Search ..... 160/341, 345, 329, 84 R, 160/DIG. 7, 196 R; 47/17, 28; 135/117; 16/93 D, 94 D, 95 D, 96 D, 102, 106

[56] References Cited

U.S. PATENT DOCUMENTS

| | | | |
|---|---|---|---|
| 1,752,610 | 4/1930 | McSpadden | 160/84 R |
| 1,899,062 | 2/1933 | Steffan | 160/84 R |
| 2,031,157 | 1/1936 | Gilson | 160/120 |
| 2,595,094 | 4/1952 | Niles | 135/87 |
| 3,487,875 | 1/1970 | Shukat et al. | 160/84 R |
| 3,883,924 | 5/1975 | Grabman | 16/94 D |
| 4,020,826 | 5/1977 | Mole | 160/DIG. 7 |
| 4,062,146 | 12/1977 | Grossman | 160/331 |
| 4,316,405 | 2/1982 | Esposito | 47/17 |

*Primary Examiner*—Ramon S. Britts

*Assistant Examiner*—David M. Purol

*Attorney, Agent, or Firm*—Merrill N. Johnson

[57] ABSTRACT

Adjustable solarium shade apparatus including a rectangular two-layer shade, the two layers being sewn together to form a series of horizontal downwardly projecting loops into each of which is inserted a tubular curtain rod. The upper edge of the shade is attached to the interior wall of the solarium closely adjacent to the uppermost edge of the glass panels forming the roof of the solarium. The shade is suspended from a series of C-shaped tracks each located on the lower surface of one of the vertical beams supporting the glass panels of the roof and side wall of the solarium. The supporting mechanism includes a series of key rings sewn to the shade above the loops in the shade, a series of eyebolts connected to the key rings and supported by a nut nested in an inner race resting on the C-shaped track and surrounded by an outer race also resting on the C-shaped track. The shade is raised and lowered by a plurality of cords each threaded successively through vertically ascending eyebolts.

4 Claims, 1 Drawing Sheet

ADJUSTABLE SOLARIUM SHADE

BACKGROUND AND SUMMARY OF THE INVENTION

Solariums and similar glass enclosed rooms are becoming increasingly popular in new and refurbished residential and commercial buildings. Particularly, in residential solariums, some form of shade or curtain which can be readily raised and lowered depending upon the position and intensity of the sun is almost a necessity for comfortable enjoyment of these glass enclosed rooms.

It is desirable that the shade be positioned close to the glass panels forming the roof portion of the solarium so as not to decrease the living area. It also is desirable when protection from the sun is not required that the shade can be stored neatly and unobtrusively, in a minimum of space. And most important, the raising the lowering of the shade should be accomplished effortlessly and without any binding or sticking of the adjusting mechanism.

We have invented a unique adjustable solarium shade which has all the foregoing features. Moreover, our adjustable solarium shade provides a decorative addition to the room as well as a long-lasting effective shield against the sun.

Most modern solariums comprise a series of glass panels as the roof and walls of the solarium mounted on a framework of metallic beams. Usually the roof of the solarium is inclined downwardly from the adjoining wall of the building and the juncture between the roof and outer wall of the solarium is a series of curved glass panels.

The supporting metal beams are often anodized aluminum extrusions which include on the lower or inner face of the beam a C-shaped or split track running the entire length of the beam. This C-shaped track provides support for a sunshade if one is desired.

Our shade serves two functions, namely, an effective and long-lasting screen against the sun and a decorative addition to the room. Hence our shade consists of two layers: an outer layer made of a preferably white durable sun resistant fabric and an inner layer of decorative fabric which can be color coordinated with the wall coverings and other appointments in the room.

In order to support our shade across the width of the glassed roof of the solarium, we have sewn a series of horizontal downwardly hanging loops in the two layer of fabric. Into each of these downwardly hanging loops we insert a hollow tubular curtain rod, thereby providing stability to the entire shade and keeping it closely and evenly spaced from the glass panels.

The upper horizontal edge of our shade is securely fastened to the wall or ceiling adjacent to the solarium so that when the shade is not required to shield the room from the sun, the shade can be raised and, folded up accordian-like against itself, stored out of the way in a minimum of space.

We have designed unique means for raising and lowering our shade along the roof and side wall of the solarium without danger of binding or sticking as the shade is moved. Our shade is suspended from the C-shaped or split tracks on the beams supporting the glass panels by a series of split key rings which are secured to the horizontal seam sewn into the two-layer shade to make the loops containing the tubular curtain rods. Each ring is fastened to an eyebolt which in turn is suspended from a nut nested axially within an inner circular race. This inner race rests on the upper surface of the lower segment of the C-shaped track and is surrounded by an outer race which also rests on the lower segment of the track.

Our shade is raised and lowered by two or more drapery cords. One end of each cord is first anchored at the base or lower edge of the shade adjacent to one of the C-shaped tracks; then the cord is threaded through the eye of each vertically ascending eyebolt supporting the shade; then through a pulley mounted on the ceiling or wall adjacent to the upper edge of the shade; then through a second pulley mounted on the ceiling or wall adjacent to one end of the upper edge of the shade; and then down the wall to a cleat.

When it is desired to raise or lower the shade, the two or more cords are grasped in the hand. If the shade is to be raised, a steady simultaneous pull on each of the drapery cords will quite effortlessly raise the shade to the desired position. And if the shade is to be lowered, a simultaneous release of the tension on the cords will cause the shade to lower due to gravity and the essentially frictionless operation of the mechanism described above. The shade is then maintained in its desired position by securing the cords to the wall mounted cleat.

BRIEF DESCRIPTION OF THE DRAWINGS

A preferred embodiment of our adjustable solarium shade is illustrated in the drawings, in which.

DETAILED DESCRIPTION OF THE INVENTION

Figure 1:
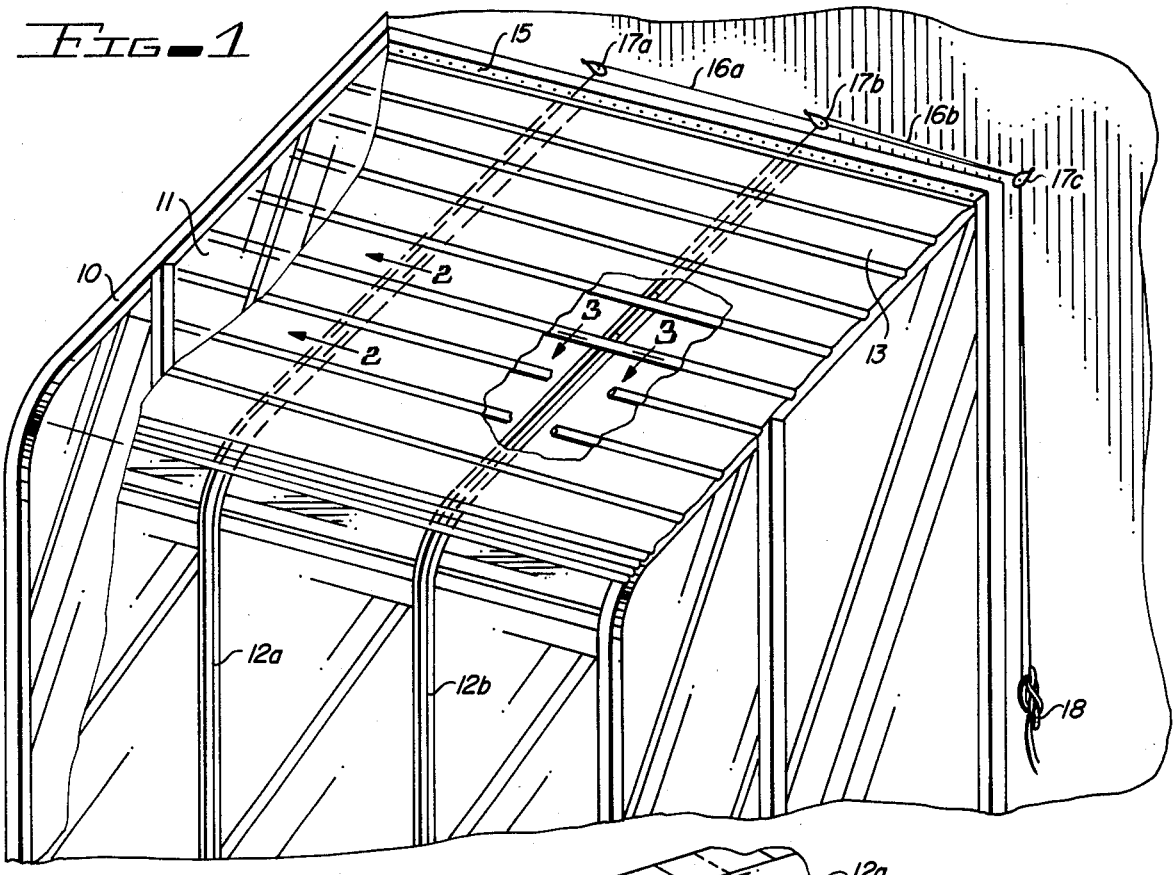
FIG. 1 is a perspective partially broken away view of our solarium shade in a partially opened position covering the roof portion of a typical solarium.

The drawings illustrate a preferred embodiment of our adjustable solarium shade. Referring to FIG. 1, solarium 10 is a typical solarium or glass enclosed room which projects outwardly from the adjoining wall of the main building. The roof and side walls of the solarium are made up of a series of rectangular glass panels 11 mounted on a series of vertical beams such as the beams shown in FIG. 1.

The structure of the solarium itself forms no part of our invention. The solarium illustrated in FIG. 1 includes the usual inclined roof, the curved glass panels forming the juncture between the inclined roof and outermost vertical wall of the solarium, and the C-shaped tracks 12*a* and 12*b* on the lower or inner surface of the vertical beams of the solarium.

FIG. 1 shows our solarium shade 13 in a partially open position shielding the interior of the room from the sun located directly overhead. Our shade 13 is constructed of two quite different materials shown as upper layer 13*a* and lower layer 13*b* in FIG. 2.

Layer 13*a* is preferably a durable white fabric especially selected for its wearability and sun resistance. Layer 13*b* is a decorative fabric chosen for its being a part of overall decor of the room and preferably color coordinated with the other appointments and wall coverings of the room.

Figure 2:
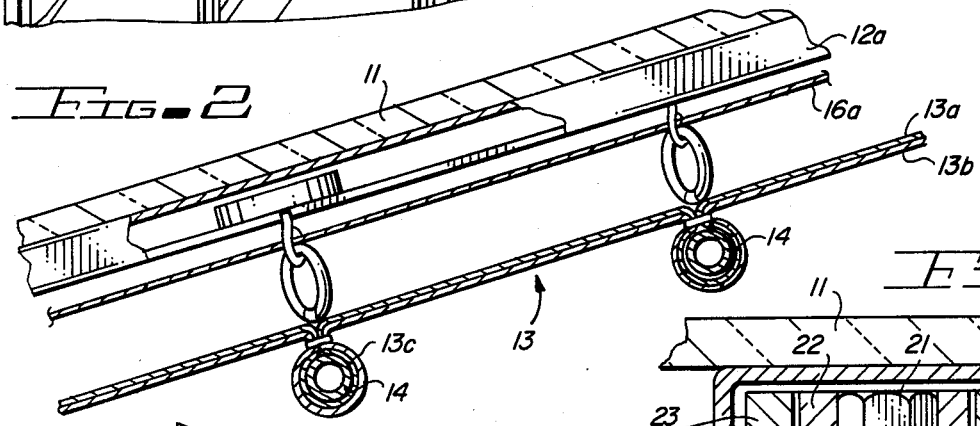
FIG. 2 is an enlarged partially broken away view of the shade supporting mechanism taken on line 2—2 of FIG. 1.
Figure 3:
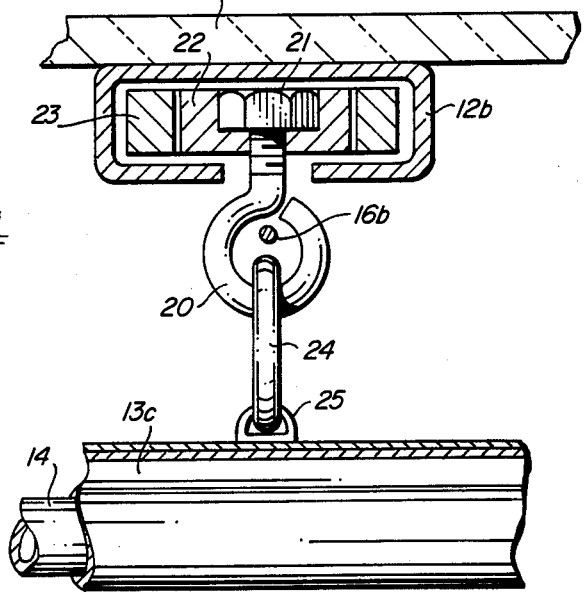
FIG. 3 is an enlarged cross sectional view of the shade supporting mechanism taken on line 3—3 of FIG. 1.

Layers 13*a* and 13*b* are sewn together to form a series of horizontal downwardly projecting loops 13*c* best shown in FIGS. 2 and 3. Into each of loops 13*c* is inserted a preferably tubular hollow curtain rod 14 as shown in FIGS. 2 and 3. The purpose of the loops 13*c* and the curtain rods 14 is to provide stability and weight to our shade 13 and to maintain the entire shade closely adjacent to the glass panels of the roof and wall of the solarium.

Rectangular shade 13 is securely fastened to the interior of the glass enclosed room at the juncture of the supporting wall of the building and the uppermost edge of the glass panels forming the roof of the solarium. Preferably the upper edge of shade 13 includes a strip 15 shown in FIG. 1 constructed of intermeshed plastic fibers such as Velcro TM which can be joined with a similar strip mounted on the wall or ceiling closely adjacent to the juncture between the glass panels and the supporting wall of the building.

The shade 13 is suspended beneath the glass panels 11 of the solarium by a unique mechanism which permits the shade to be raised or lowered almost effortlessly and without any binding or sticking as the position of the shade is adjusted. This mechanism which forms part of our adjustable solarium shade is shown in FIGS. 2, 3 and 4.

Figure 4:
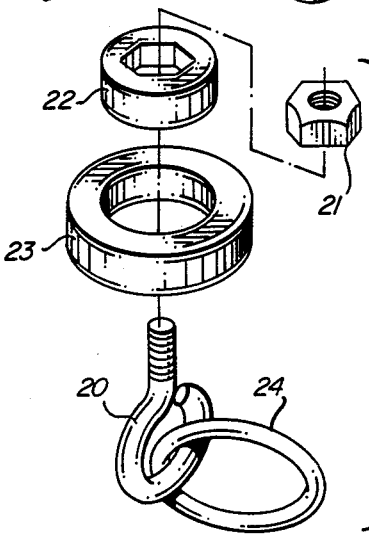
FIG. 4 is an exploded view of the supporting mechanism for our shade.

FIG. 4 is an exploded view of the elements which support the shade beneath the glass panels of the solarium. FIG. 3 illustrates how these elements connect the shade to the solarium. And FIG. 2 illustrates how the shade is raised and lowered.

Hexagonal nut 21 is nested axially within a gexagonal recess in an inner race 22 which is surrounded by an outer race 23. Races 22 and 23 are preferably made of nylon or a similar rigid and slippery surfaced plastic. Eyebolt 20 is screwed into nut 21 and split key ring 24 is connected to the eye of eyebolt 20. Each key ring 24 is sewn to upper surface of shade 13 preferably by a strip of durable tape 25 shown in FIG. 3. Rings 24 are attached to shade 13 preferably at the seam in the shade which forms loop 13*c* and at a point directly beneath track 12*a* or 12*b*.

As best shown in FIG. 3, eyebolt 20 is suspended from nut 21 which is supported by inner race 22, which in turn rests upon the upper surface of the lower segment of track 12*b*. Outer race 23 also rests upon the lower segment of track 12*b*.

The unique arrangement of eyebolt 20, nut 21 and races 22 and 23 permits raising and lowering shade 13 quite effortlessly. This is done by a plurality of drapery cords such as 16*a* and 16*b* shown respectively in FIGS. 2 and 3 working together as shown in FIG. 1.

Each cord is anchored at the base or lower edge of the shade adjacent to one of the tracks and then successively threaded through the eyes of the eyebolts vertically ascending the track. Each cord is then threaded through pulleys 17*a*, 17*b* and 17*c* mounted on the wall of the solarium adjacent to the upper edge of shade 13. Finally, cords 16*a* and 16*b* are secured to a cleat 18 mounted on the wall at hand height.

When a person in the glass enclosed room desires to adjust the position of the shade, the cords are unsecured from cleat 18 and firmly grasped in the hand. If the shape is to be raised to its stored position, a steady simultaneous pull on cords 16*a* and 16*b* will cause the shade to fold up upon itself accordian-like for storage unobtrusively against the wall at the uppermost portion of the solarium room.

If the shade is to be lowered, a simultaneous release of the tension on cords 16*a* and 16*b* will cause the shade to lower along tracks 12*a* and 12*b* due to the weight of the shade and rods 14 and the almost frictionless operation of races 22 and 23 within tracks 12*a* and 12*b*. Upon reaching the desired position of shade 13, the shade is held in this position by securing the cords upon wall mounted cleat 18.

While we have shown and described in detail a preferred form of our adjustable solarium shade, it should be understood that such disclosure is only by way of example and that changes in the details of construction and rearrangement of parts may be made without departing from the spirit and scope of our invention as hereinafter claimed.

I claim:

1. An adjustable shade for shielding from the sun a room having an inclined glass panelled roof and an adjoining glass panelled side wall supported by a plurality of vertically ascending beams each having a C-shaped track on its inside surface comprising a rectangular shade having sewn into the shade at spaced vertical intervals a series of vertically spaced horizontal loops extending downwardly across the width of the shade, the upper horizontal edge of the shade being attached to a wall of the room immediately beneath the uppermost edge of the glass panels forming the roof of the room, a plurality of curtain rods each located within one of the horizontally extending loops in the shade, the shade being suspended immediately adjacent to the glass panels forming the roof and side wall of the room from the C-shaped tracks on the inside of the beams by a series of key rings sewn to the shade above each of the loops in the shade and a series of eyebolts each connected to one of the key rings, each eyebolt supported by a nut nested in a cylindrical race resting upon one of the C-shaped tracks, and the shade being raised and lowered by a plurality of cords, each cord anchored at the lower edge of the shade adjacent to one of the C-shaped tracks and then successively threaded through the eyes of the vertically ascending eyebolts and a pulley mounted on the wall of the room.

2. An adjustable shade for shielding from the sun a room having an inclined glass panelled roof and adjoining side wall supported by vertically ascending beams each having a C-shaped track on its inner surface comprising a two-layer shade having an outer layer of sun resistant material and an inner layer of a decorative material, said shade being sewn together at spaced vertical intervals into a series of vertically spaced horizontal two-layer loops extending downwardly across the width of the shade, the upper edge of the shade being securely fastened to a wall of the room closely adjacent to the uppermost edge of the glass panels forming the roof of the room, a plurality of tubular rods each positioned within one of the downwardly extending loops in the two-layer shade, the shade being suspended closely adjacent to the glass panels of the roof and side wall of the room from the C-shaped tracks on the beams by means of a series of key rings sewn to the shade above the loops in the shade and a series of eyebolts each connected to one of the key rings, and each eyebolt being supported by a nut nested within a cylindrical race resting upon one of the C-shaped tracks and surrounded by an annular outer race also resting upon the C-shaped track, and the shade being raised and lowered by a plurality of cords, each cord secured to the lower edge of the shade lying adjacent to one of the C-shaped tracks and then successively threaded through the eyes of each of the vertically ascending eyebolts and then through a pulley mounted on the adjacent wall of the room.

3. An adjustable shade for shielding from the sun a room having an inclined glass panelled roof and an adjoining glass panelled side wall supported by a plurality of vertically ascending beams each having a C-shaped track on its inside surface comprising a retangular shade having sewn into the shade at spaced vertical intervals a series of vertically spaced horizontal loops extending downwardly across the width of the shade, the upper horizontal edge of the shade being attached to a wall of the room immediately beneath the uppermost edge of the glass panels forming the roof of the room, a plurality of curtain rods each located within one of the horizontally extending loops in the shade, the shade being suspended immediately adjacent to the glass panels forming the roof and side wall of the room from the C-shaped tracks on the inside of the beams by a series of key rings sewn to the shade above each of the loops in the shade and a series of eyebolts each connected to one of the key rings, each eyebolt supported by a nut nested in a cylindrical race resting upon one of the C-shaped tracks, an annular outer race surrounding the race which supports the nut and eyebolt, and the shade being raised and lowered by a plurality of cords, each cord anchored at the lower edge of the shade adjacent to one of the C-shaped tracks and then successively threaded through the eyes of the vertically ascending eyebolts and a pulley mounted on the wall of the room.

4. An adjustable shade for shielding from the sun a room having an inclined glass panelled roof and an adjoining glass panelled side wall supported by a plurality of vertically ascending beams each having a C-shaped track on its inside surface comprising a rectangular shade having sewn into the shade at spaced vertical intervals a series of vertically spaced horizontal loops extending downwardly across the width of the shade, said shade having an outer layer made of a durable sun resistant material and an inner layer made of a decorative material, the upper horizontal edge of the shade being attached to a wall of the room immediately beneath the uppermost edge of the glass panels forming the roof of the room, a plurality of curtain rods each located within one of the horizontally extending loops in the shade, the shade being suspended immediately adjacent to the glass panels forming the roof and side wall of the room from the C-shaped tracks on the inside of the beams by a series of key rings sewn to the shade above each of the loops in the shade and a series of eyebolts each connected to one of the key rings, each eyebolt supported by a nut nested in a cylindrical race resting upon one of the C-shaped tracks, an annular outer race surrounding the race which supports the nut and eyebolt, and the shade being raised and lowered by a plurality of cords, each cord anchored at the lower edge of the shade adjacent to one of the C-shaped tracks and then successively threaded through the eyes of the vertically ascending eyebolts and a pulley mounted on the wall of the room.

* * * * *